US010426984B2

(12) United States Patent
Pipe et al.

(10) Patent No.: US 10,426,984 B2
(45) Date of Patent: Oct. 1, 2019

(54) SPRINKLER ASSEMBLY

(71) Applicant: The Viking Corporation, Hastings, MI (US)

(72) Inventors: Jed Pipe, Byron Center, MI (US); Shawn G. Orr, Grand Rapids, MI (US)

(73) Assignee: The Viking Corporation, Hastings, MI (US)

( * ) Notice: Subject to any disclaimer, the term of this patent is extended or adjusted under 35 U.S.C. 154(b) by 373 days.

(21) Appl. No.: 14/676,383

(22) Filed: Apr. 1, 2015

(65) Prior Publication Data

US 2015/0297927 A1 Oct. 22, 2015

Related U.S. Application Data

(60) Provisional application No. 61/980,312, filed on Apr. 16, 2014.

(51) Int. Cl.

| | |
|---|---|
| ***A62C 37/12*** | (2006.01) |
| ***A62C 35/68*** | (2006.01) |
| ***B05B 1/26*** | (2006.01) |
| ***A62C 37/14*** | (2006.01) |

(52) U.S. Cl.

CPC ..... *A62C 35/68* (2013.01); *A62C 37/12* (2013.01); *A62C 37/14* (2013.01); *B05B 1/265* (2013.01); *B05B 1/267* (2013.01)

(58) Field of Classification Search

CPC ..... A62C 37/14; A62C 37/12; A62C 35/68; B05B 1/265; B05B 1/267

USPC ..... 239/524, 504, 518; 169/37

See application file for complete search history.

(56) References Cited

U.S. PATENT DOCUMENTS

| | | | | |
|---|---|---|---|---|
| 2,076,483 | A * | 4/1937 | Rowley | B05B 1/265 169/37 |
| 2,135,138 | A | 11/1938 | Kendall | |
| 3,768,736 | A | 10/1973 | Cox | |
| 3,904,126 | A | 9/1975 | Allard | |
| 4,585,069 | A | 4/1986 | Whitaker | |
| 5,669,449 | A | 9/1997 | Polan et al. | |
| 5,727,737 | A * | 3/1998 | Bosio | B05B 1/262 169/37 |
| 6,374,920 | B1 * | 4/2002 | Phillips | A62C 37/14 169/37 |

(Continued)

FOREIGN PATENT DOCUMENTS

| | | |
|---|---|---|
| CA | 2170481 A1 | 8/1996 |

*Primary Examiner* — Jason J Boeckmann

(74) *Attorney, Agent, or Firm* — Harness, Dickey & Pierce, P.L.C.

(57) ABSTRACT

A sprinkler assembly for use in an attic or under a sloped roof or ceiling and includes a body having an inlet opening and a discharge opening. A support extends from the body and a closure device is releasably positioned at the discharge opening to close the passageway. A heat responsive trigger releasably retains the closure device at the discharge opening of the body. A flow shaper is supported by the support and includes a transverse wall portion intersecting a central axis of the discharge opening. A pair of laterally spaced side walls each extend from the transverse wall portion toward the body and a pair of mounting base portions extend from the pair of side walls and connect the flow shaper to the support. The flow shaper provides a simple and inexpensive design for providing adequate distribution of fire suppressant both laterally and directly beneath the sprinkler.

31 Claims, 12 Drawing Sheets

(56) References Cited

U.S. PATENT DOCUMENTS

| | | | | |
|---|---|---|---|---|
| 6,889,774 | B2 | 5/2005 | Multer et al. | |
| 6,920,937 | B2 | 7/2005 | Neill et al. | |
| 7,331,399 | B2 | 2/2008 | Multer | |
| 7,841,418 | B2 | 11/2010 | Pahila et al. | |
| 7,854,269 | B2 | 12/2010 | Franson et al. | |
| 8,402,657 | B2 | 3/2013 | Franson et al. | |
| 2001/0042795 | A1* | 11/2001 | Franson ..... | A62C 37/14<br>239/214 |
| 2006/0219819 | A1 | 10/2006 | Franson et al. | |
| 2008/0202773 | A1 | 8/2008 | Pigeon | |
| 2010/0078181 | A1 | 4/2010 | Fischer et al. | |
| 2011/0127050 | A1 | 6/2011 | Pahila et al. | |
| 2014/0262356 | A1* | 9/2014 | Ringer ..... | A62C 37/11<br>169/37 |
| 2014/0262357 | A1* | 9/2014 | Ringer ..... | A62C 37/11<br>169/37 |
| 2016/0023029 | A1* | 1/2016 | Almeida ..... | A62C 37/09<br>169/37 |

* cited by examiner

SPRINKLER ASSEMBLY

CROSS-REFERENCE TO RELATED APPLICATIONS

This application claims the benefit of U.S. Provisional Application No. 61/980,312, filed Apr. 16, 2014. The entire disclosure of the above application is incorporated herein by reference.

FIELD

The present disclosure relates to a sprinkler assembly, and more particularly to a sprinkler assembly having a flow shaper designed to generate a laterally sideward and downward concentrated spray pattern.

BACKGROUND

This section provides background information related to the present disclosure which is not necessarily prior art.

One of the challenges of designing fire protection sprinklers is to design the sprinkler to provide a spray distribution of fire suppressant fluid to meet the needs of the desired application. The design of sprinklers for use in an attic or under a sloped roof or ceiling can often present challenges to provide adequate distribution of fire suppressant both directly below and laterally to each side of the sprinkler.

SUMMARY

This section provides a general summary of the disclosure, and is not a comprehensive disclosure of its full scope or all of its features.

The present disclosure provides a sprinkler assembly for use in an attic or under a sloped roof or ceiling and includes a body including a passageway having an inlet opening and a discharge opening. A support extends from the body and a closure device is releasably positioned at the discharge opening to close the passageway. A heat responsive trigger releasably retains the closure device at the discharge opening of the body. A flow shaper is supported by the support and includes a transverse wall portion intersecting a central axis of the discharge opening. A pair of laterally spaced side walls each extend from the transverse wall portion toward the body and a pair of mounting base portions extend from the pair of side walls and connect the flow shaper to the support. The flow shaper provides a simple and inexpensive design for providing adequate distribution of fire suppressant both laterally and directly beneath the sprinkler.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
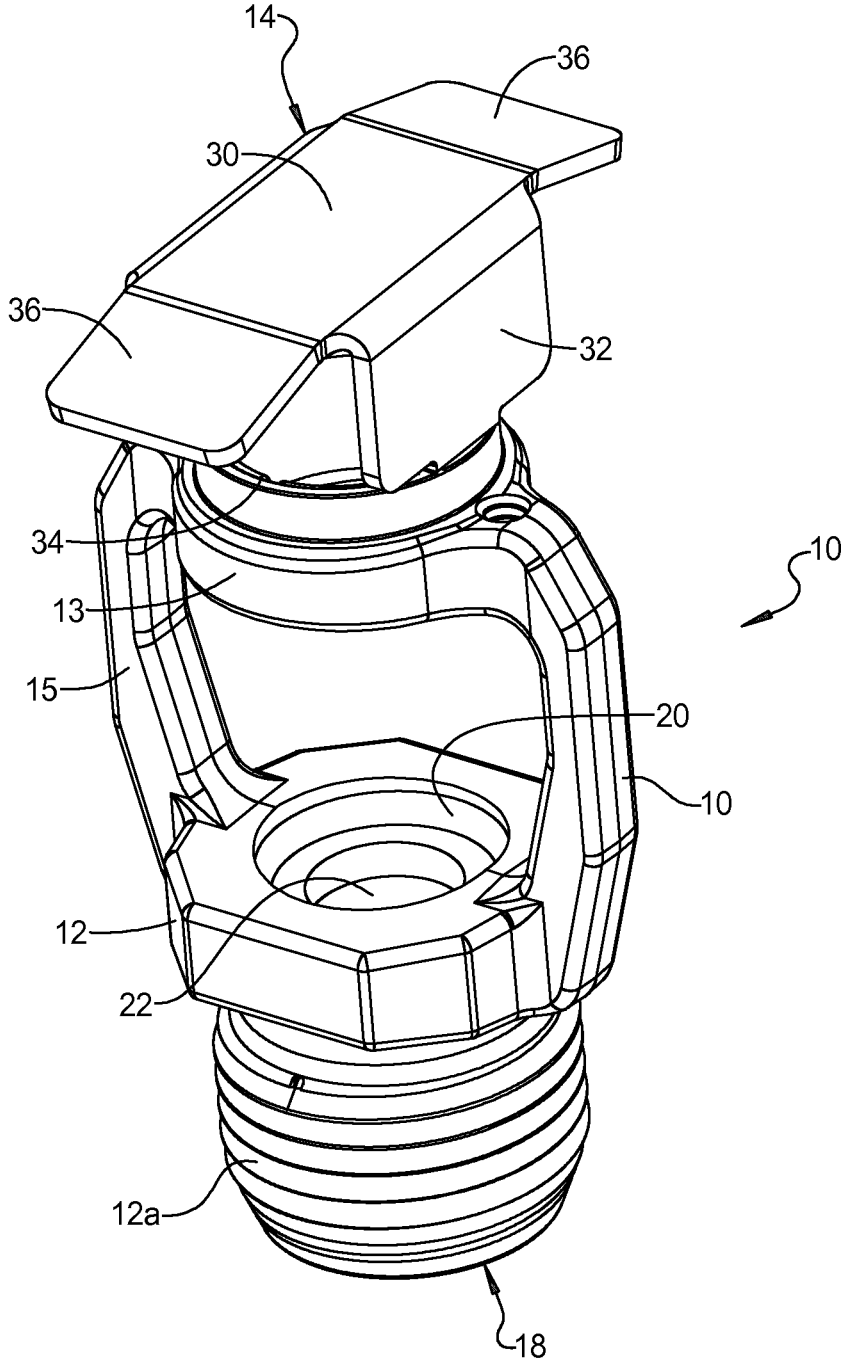
FIG. 1 is a perspective view of a sprinkler body having a flow shaper mounted thereto according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
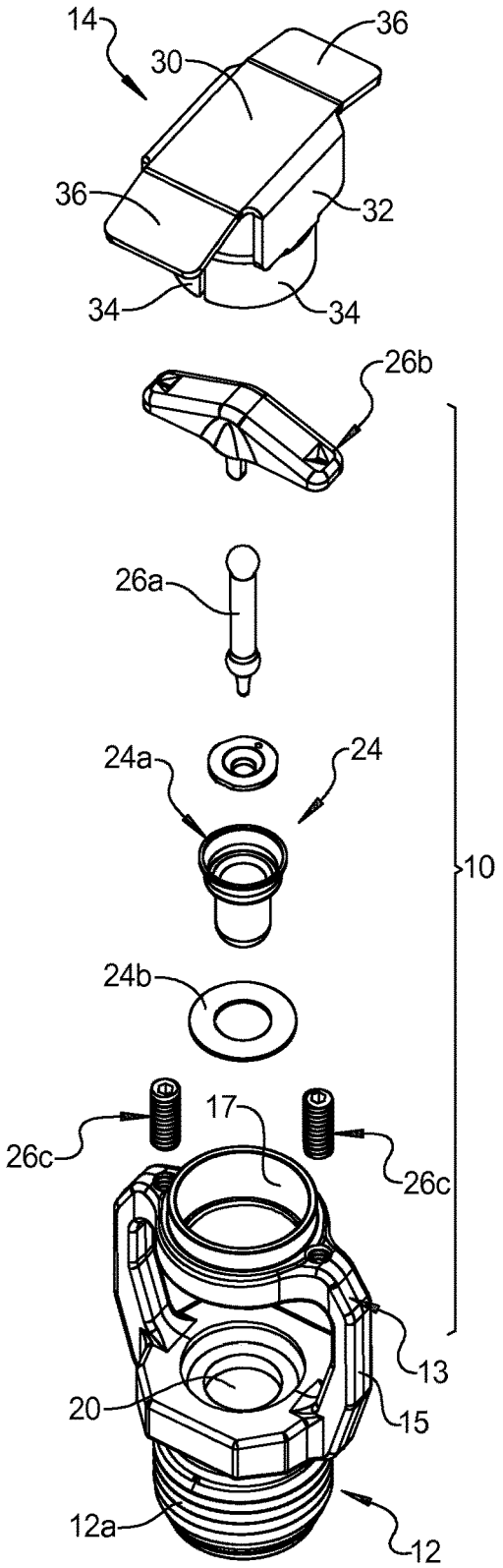
FIG. 2 is an exploded perspective view of the sprinkler shown in FIG. 1.
Figure 3:
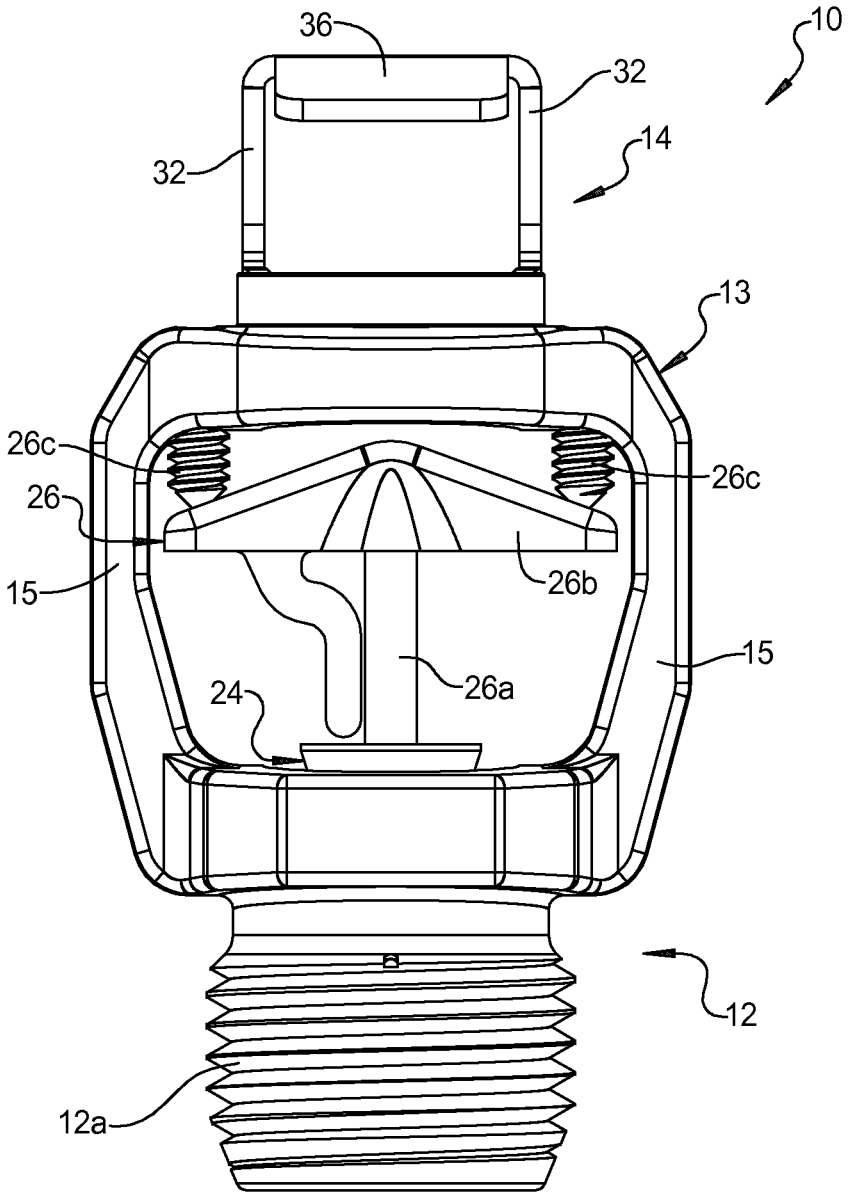
FIG. 3 is a side plan view of the sprinkler shown in FIG. 1.
Figure 4:
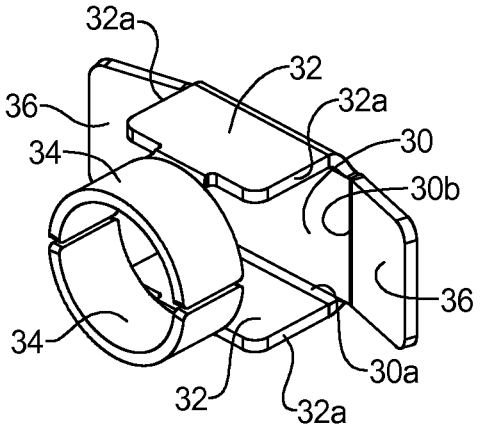
FIG. 4 is a perspective view of the flow shaper shown in FIG. 1.
Figure 5:
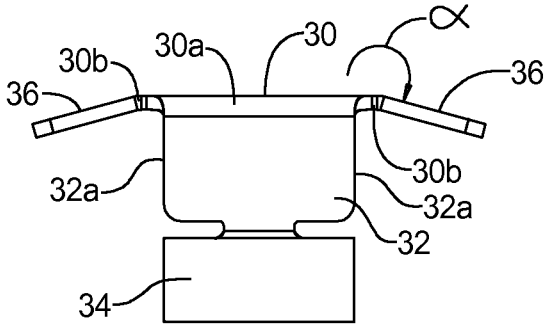
FIG. 5 is a side plan view of the flow shaper shown in FIG. 4.

As best seen in FIGS. 1-3, sprinkler assembly 10 includes a sprinkler body 12, a support 13 that extends from body 12, and a flow-shaper member 14. The support 13 is connected to the body 12 by a pair of frame arms 15 that are each generally centered in a first plane. The support 13 can be annular in shape and can define an opening 17 extending there through. Body 12 and support 13 preferably comprise a brass casting. Though, it should be understood that the body and support may be separately formed and, further, may be formed from other materials and by other forming methods. Body 12 comprises a generally tubular body with a threaded portion 12*a* for connecting the sprinkler assembly to a fluid supply line (not shown) and, further, includes an inlet opening 18, a discharge opening 20, and a fluid passageway 22. Passageway 22 extends between inlet opening 18 through threaded portion 12*a* to discharge opening 20 so that when body 12 is coupled to the supply line and sprinkler assembly 10 is opened or actuated, such as in the case of a fire, fluid will flow from inlet opening 18 through passageway 22 and out from discharge opening 20 as a column of fluid.

As best seen in FIGS. 2 and 3, sprinkler assembly 10 further includes a closure device 24 releasably positioned at the discharge opening 20 of body 12 to close the passageway 22. The closure device 24 is shown as a pip cap 24*a* and spring seal 24*b*, although other types of closure devices can be used. A heat responsive trigger device 26 is mounted in a manner to releasably retain the closure device 24 at the discharge opening 20 of body 12 to thereby maintain the passageway 22 closed until the trigger device 26 is activated. As shown, the heat responsive trigger device, as shown, includes a glass bulb 26*a* and a transverse strut 26*b* that are secured in place against the closure device 24 by a pair of set screws 26*c*. The heat responsive trigger device 26 can take on many alternative forms.

With reference to FIGS. 1-5, the flow shaper 14 is mounted to the support 13 and includes a transverse wall portion 30 intersecting a central axis X of the discharge opening 20 at a location spaced downstream along the central axis X from the support 13. A pair of laterally spaced side walls 32 extend from a first pair of side edges 30*a* of the transverse wall portion 30 and axially toward the body 12. The pair of side walls 32 can be generally perpendicular to or alternatively parallel to the first plane. A pair of mounting base portions 34 extend from the pair of side walls 32 and are received in the opening 17 of the support 13 for connecting the flow shaper 14 to the support 13. The mounting base portions 34 can take on various shapes as illustrated in the various embodiments of the application. A pair of extensions 36 extend from opposite end edges 30*b* of the transverse wall portion 30 and extend laterally beyond the end edges 32*a* of the pair of side walls 32 away from the first plane. The pair of extensions 36 can be angled relative to the transverse wall portion by an angle $\alpha$ of greater than 180° and less than 240°, and more preferably between 190° and 200°, and even more specifically, approximately 195°. The angle $\alpha$ utilized can be determined based upon the pitch of the roof of an attic or other environment where the sprinkler is being used.

The pair of mounting base portions 34 can be semi-annular to fit within the annular opening 17 of the support 13. The base portions 34 can be secured within the opening 17 of the support 13 by welding, solder, crimping or other fastening techniques.

The transverse wall portion 30 can be generally planar or can have a curved shape, bends, undulations or other shapes formed therein. The pair of laterally spaced side walls 32 can be generally perpendicular to the transverse wall portion 30 and can be generally planar or have a curved shape, bends, undulations or other shapes formed therein. The extensions 36 can be generally planar or have a curved shape, bends, undulations or other shapes formed therein. The transverse wall portion 30, sidewalls 32 and extensions 36 can also be provided with apertures, slots or other openings therein. In addition, the edges of the sidewalls 32 and extensions 36 can be provided with open-ended slots to provide desired flow distribution patterns.

Figure 6:
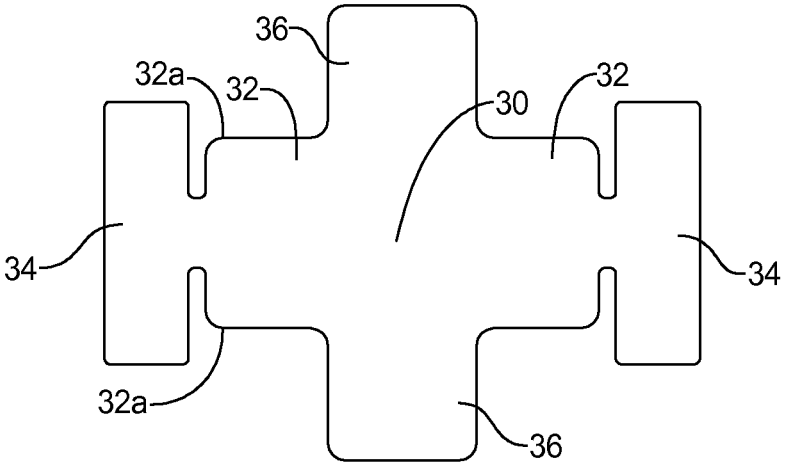
FIG. 6 is a plan view of an exemplary metal blank used to form the flow shaper according to the principles of the present disclosure.

Flow shaper 14 can be formed from a single metal plate so that the shaping of the flow shaper 14 can be highly simplified as compared to other deflector designs known in the art. The metal can include copper, brass or other suitable metals. As shown in FIG. 6, the flow shaper 14 can be formed from a flat metal stamping generally as shown, that defines each of the transverse wall portion 30, sidewalls 32, base portions 34 and extensions 36, as labeled.

Figure 7:
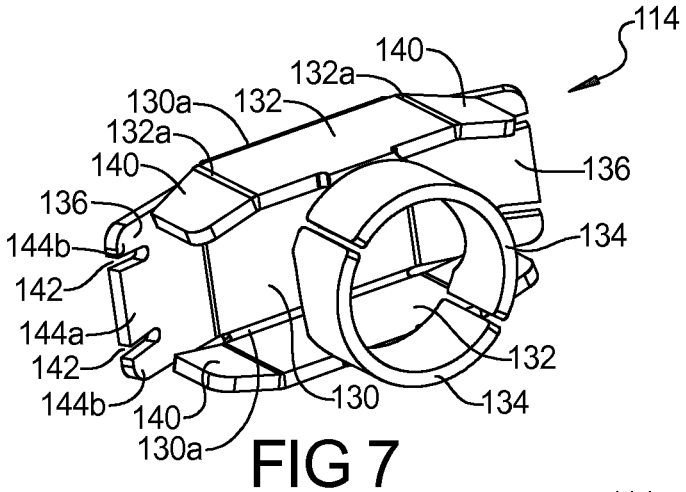
FIG. 7 is a perspective view of the flow shaper according to an alternative embodiment of the present disclosure.
Figure 8:
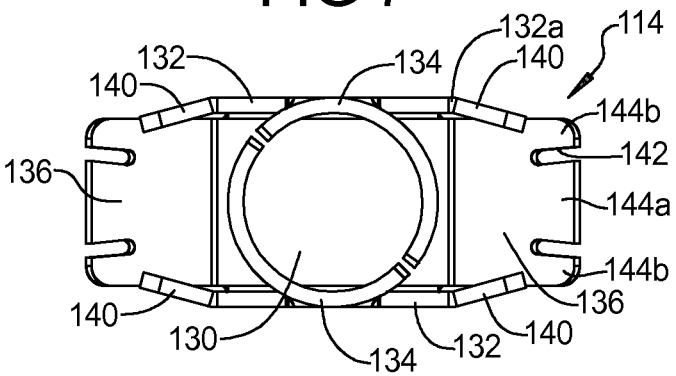
FIG. 8 is a bottom plan view of the flow shaper shown in FIG. 7.
Figure 9:
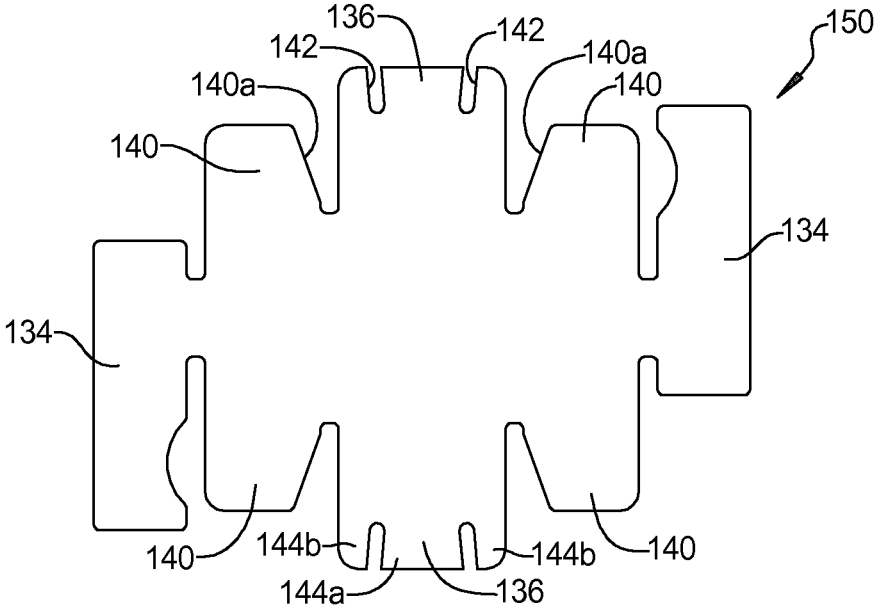
FIG. 9 is a plan view of an exemplary metal blank used to form the flow shaper of FIG. 7.

With reference to FIGS. 7-9, an alternative flow shaper 114 will now be described. The flow shaper 114 includes a transverse wall portion 130 intersecting a central axis X of the discharge opening 20 at a location spaced downstream from the support 13. A pair of laterally spaced sidewalls 132 extend from a pair of side edges 130*a* of the transverse wall portion 130 and axially toward the body 12. A pair of mounting base portions 134 extend from the pair of sidewalls 132 and are received in the opening 17 of the support 13 for connecting the flow shaper 114 to the support 13. A pair of extensions 136 extend from opposite end edges 130*b* of the transverse wall portion 130 and extend laterally beyond the end edges of the pair of sidewalls 132. The pair of extensions 136 can be angled relative to the transverse wall portion by an angle of greater than 180° and less than 240° in the same manner as the extensions 36 in the previous embodiment.

A pair of side wall extensions 140 extend from the end edges 132*a* of the sidewalls 132. An upper edge 140*a* of the end wall extensions 140 can be angled so as to approximately align with the angle of the pair of extensions 136. The pair of side wall extensions 140 can also be bent inwardly or outwardly (not shown) so as to redirect the water flow toward or away from the pair of extensions 136. The pair of extensions 136 can include one or more slots 142 that define tines 144 disposed at the ends of the pair of extensions 136. In the embodiment shown, a pair of slots 142 are provided in the end of each extension 136 and the tines 144 include a central tine 144*a* and a pair of outer tines 144*b*. The pair of slots 142 can include a pair of lateral sidewalls that are parallel or nonparallel to one another and can include a semi-circular base that connects each of the lateral sidewalls. The shape of the sidewalls and base of the slots 142 can be varied in many ways to achieve different flow distributions. FIG. 9 shows the flow shaper 114 formed from a single plate 150.

Figure 10:
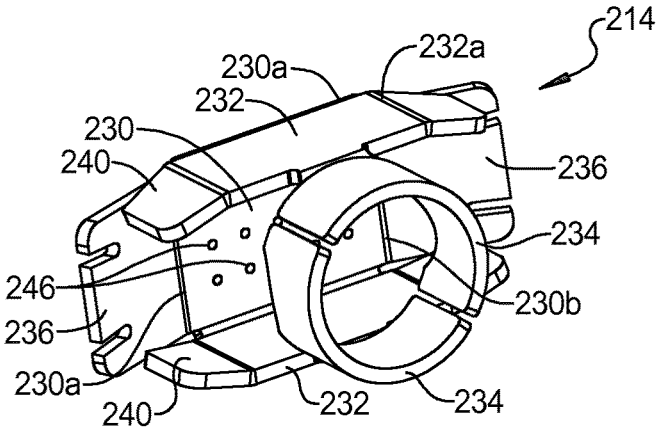
FIG. 10 is a perspective view of the flow shaper according to an alternative embodiment of the present disclosure.
Figure 11:
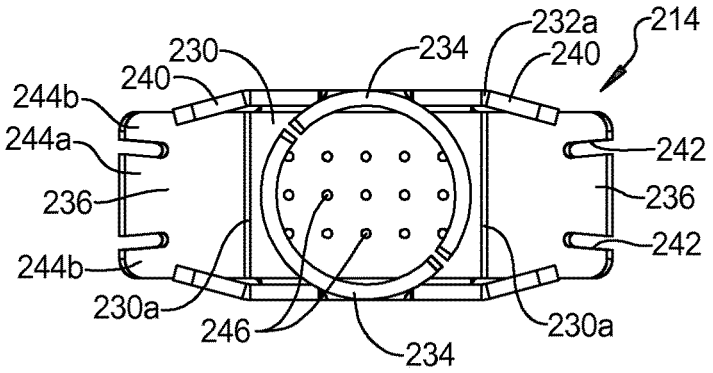
FIG. 11 is a bottom plan view of the flow shaper shown in FIG. 10.
Figure 12:
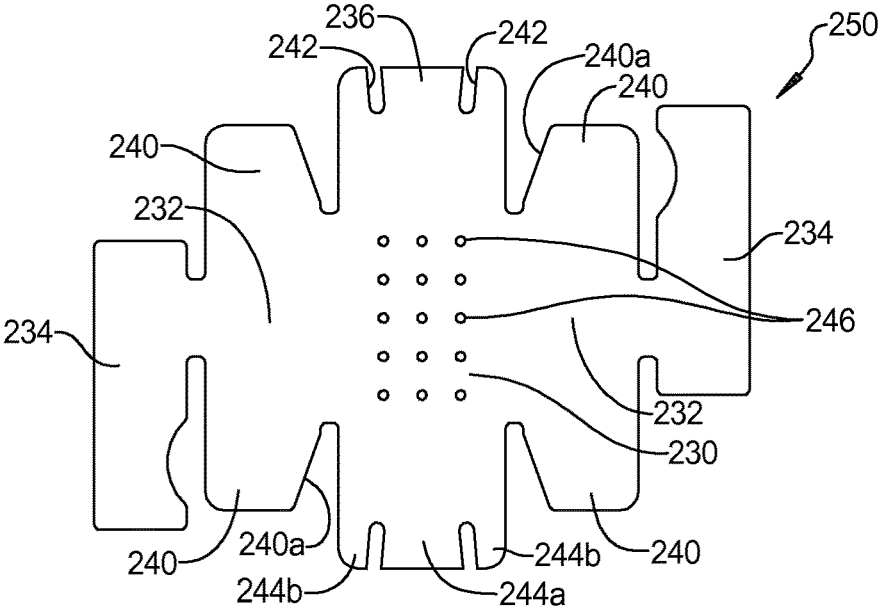
FIG. 12 is a plan view of an exemplary metal blank used to form the flow shaper of FIG. 10.

With reference to FIGS. 10-12, an alternative flow shaper 214 will now be described. The flow shaper 214 includes a transverse wall portion 230 intersecting a central axis X of the discharge opening 20 at a location spaced downstream from the support 13. A pair of laterally spaced sidewalls 232 extend from a pair of side edges 230*a* of the transverse wall portion 230 and axially toward the body 12. A pair of mounting base portions 234 extend from the pair of sidewalls 232 and are received in the opening 17 of the support 13 for connecting the flow shaper 214 to the support 13. A pair of extensions 236 extend from opposite end edges 230*b* of the transverse wall portion 230 and extend laterally beyond the end edges of the pair of sidewalls 232. The pair of extensions 236 can be angled relative to the transverse wall portion by an angle of greater than 180° and less than 240° in the same manner as the extensions 236 in the previous embodiment of FIGS. 4-6.

A pair of side wall extensions 240 extend from the end edges 232*a* of the sidewalls 232. An upper edge 240*a* of the end wall extensions 240 can be angled so as to approximately align with the angle α of the pair of extensions 236. The pair of side wall extensions 240 can also be bent inwardly or outwardly (not shown) so as to redirect the water flow toward or away from the pair of extensions 236. The pair of extensions 236 can include one or more slots 242 that define tines 244 disposed at the ends of the pair of extensions 236. In the embodiment shown, a pair of slots 242 are provided in the end of each extension 236 and the tines 244 include a central tine 244*a* and a pair of outer tines 244*b*. The pair of slots 242 can include a pair of lateral sidewalls that are parallel or nonparallel to one another and can include a semi-circular base that connects each of the lateral sidewalls. The shape of the sidewalls and the base of the slots 242 can be varied in many ways to achieve different flow distributions. The transverse wall portion 230 can include at least one, and more preferably a plurality of apertures 246 of circular or other various shapes extending therethrough that would allow a mist or spray to pass through the transverse wall portion 230 to wet the ceiling or roof structure above the sprinkler 10. The number, size and arrangement of the apertures 246 can be varied depending upon the amount of spray that is desired to pass through the transverse wall portion 230. FIG. 12 shows the flow shaper 214 formed from a single plate 250.

Figure 13:
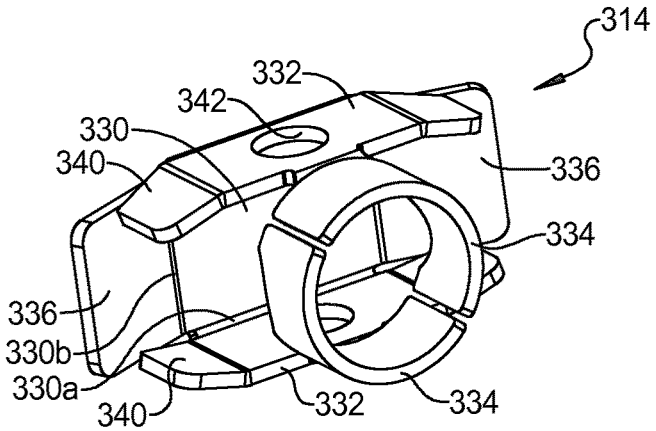
FIG. 13 is a perspective view of the flow shaper according to an alternative embodiment of the present disclosure.
Figure 14:
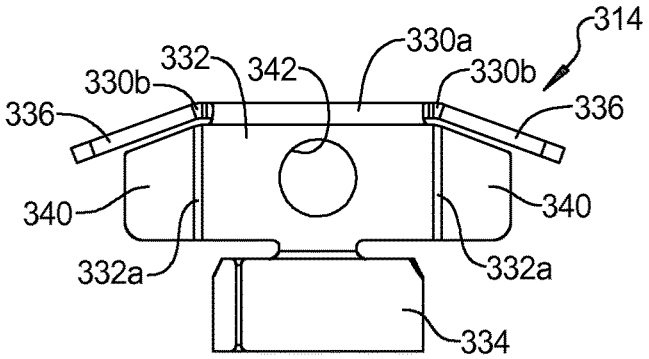
FIG. 14 is a side plan view of the flow shaper shown in FIG. 13.
Figure 15:
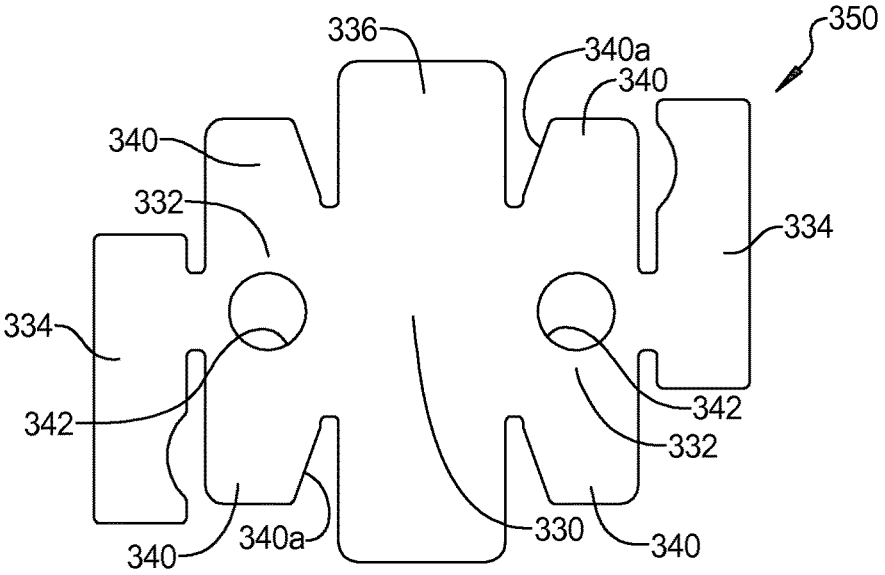
FIG. 15 is a plan view of an exemplary metal blank used to form the flow shaper of FIG. 13.

With reference to FIGS. 13-15, an alternative flow shaper 314 will now be described. The flow shaper 314 includes a transverse wall portion 330 intersecting a central axis X of the discharge opening 20 at a location spaced downstream from the support 13. A pair of laterally spaced sidewalls 332 extend from a pair of side edges 330*a* of the transverse wall portion 330 and axially toward the body 12. A pair of mounting base portions 334 extend from the pair of sidewalls 332 and are received in the opening 17 of the support 13 for connecting the flow shaper 314 to the support 13. A pair of extensions 336 extend from opposite end edges 330*b* of the transverse wall portion 330 and extend laterally beyond the end edges of the pair of sidewalls 332. The pair of extensions 336 can be angled relative to the transverse wall portion by an angle α of greater than 180° and less than 240° in the same manner as the extensions 36 in the previous embodiment of FIGS. 4-6.

A pair of side wall extensions 340 extend from the end edges 332*a* of the sidewalls 332. An upper edge 340*a* of the end wall extensions 340 can be angled so as to approximately align with the angle of the pair of extensions 336. The pair of side wall extensions 340 can also be bent inwardly or outwardly (not shown) so as to direct the water flow toward or away from the pair of extensions 336. The pair of laterally spaced sidewalls 332 can include one or more apertures 342 that allow a controlled flow of water laterally outward through the sidewalls 332. In the embodiment shown in FIGS. 13-15, only one aperture 342 is shown although it should be understood that multiple apertures can be sized, shaped, spaced and arranged to provide a desired water distribution therethrough. FIG. 15 shows the flow shaper 314 formed from a single plate 350.

Figure 16:
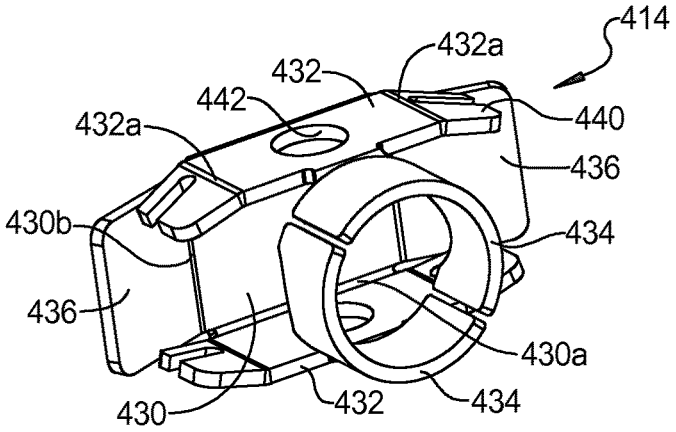
FIG. 16 is a perspective view of the flow shaper according to an alternative embodiment of the present disclosure.
Figure 17:
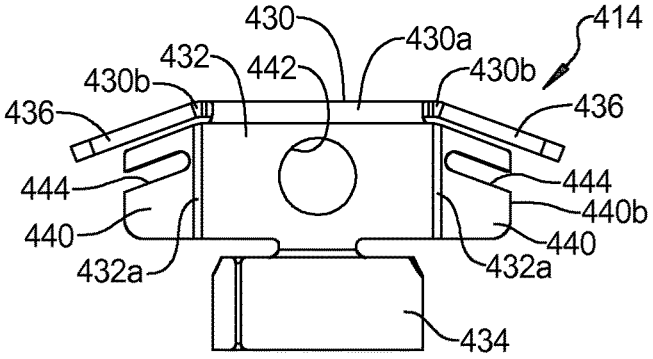
FIG. 17 is a side plan view of the flow shaper shown in FIG. 16.
Figure 18:
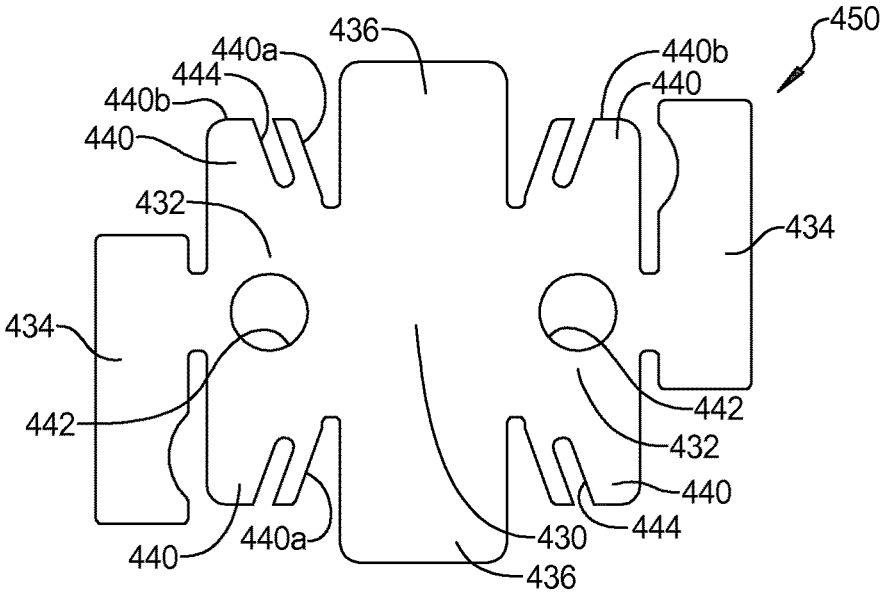
FIG. 18 is a plan view of an exemplary metal blank used to form the flow shaper of FIG. 16.
Figure 19:
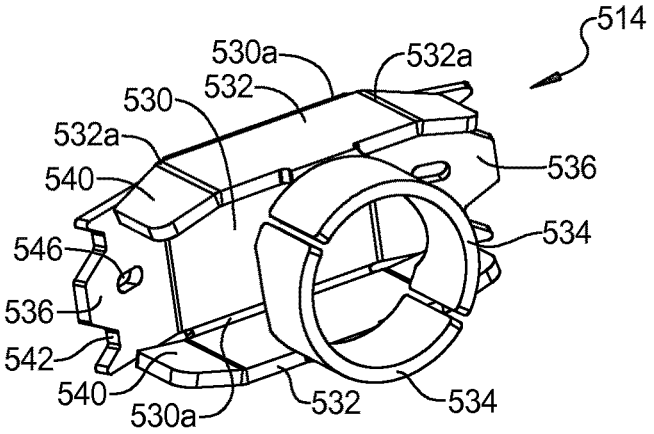
FIG. 19 is a perspective view of the flow shaper according to an alternative embodiment of the present disclosure.
Figure 20:
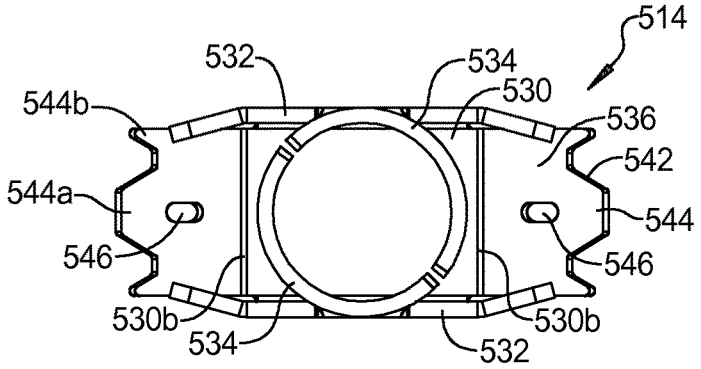
FIG. 20 is a bottom plan view of the flow shaper shown in FIG. 19.

With reference to FIGS. 16-18, an alternative flow shaper 414 will now be described. The flow shaper 414 includes a transverse wall portion 430 intersecting a central axis X of the discharge opening 20 at a location spaced downstream from the support 13. A pair of laterally spaced sidewalls 432 extend from a pair of side edges 430*a* of the transverse wall portion 430 and axially toward the body 12. A pair of mounting base portions 434 extend from the pair of sidewalls 432 and are received in the opening 17 of the support 13 for connecting the flow shaper 414 to the support 13. A pair of extensions 436 extend from opposite end edges 430*b* of the transverse wall portion 430 and extend laterally beyond the end edges 432*a* of the pair of sidewalls 432. The pair of extensions 436 can be angled relative to the transverse wall portion by an angle α of greater than 180° and less than 240° in the same manner as the extensions 36 in the previous embodiment of FIGS. 4-6.

A pair of side wall extensions 440 extend from the end edges 432*a* of the sidewalls 432. An upper edge 440*a* of the end wall extensions 440 can be angled so as to approximately align with the angle α of the pair of extensions 436. The pair of side wall extensions 440 can also be bent inwardly or outwardly (not shown) so as to redirect the water flow toward or away from the pair of extensions 436. The pair of laterally spaced sidewalls 432 can include one or more apertures 442 that allow a controlled flow of water laterally outward through the sidewalls 432. In the embodiment shown in FIGS. 16-18, only one aperture 442 is shown although it should be understood that multiple apertures can be sized, shaped, spaced and arranged to provide a desired water distribution therethrough. The pair of side wall extensions 440 can be provided with one or more slots 444 in an end edge 440*b* or along another edge thereof. FIG. 18 shows the flow shaper 414 formed from a single plate 450.

With reference to FIGS. 19-23, an alternative flow shaper 514 will now be described. The flow shaper 514 includes a transverse wall portion 530 intersecting a central axis X of the discharge opening 20 at a location spaced downstream from the support 13. A pair of laterally spaced sidewalls 532 extend from a pair of side edges 530*a* of the transverse wall portion 530 and axially toward the body 12. A pair of mounting base portions 534 extend from the pair of sidewalls 532 and are received in the opening 17 of the support 13 for connecting the flow shaper 514 to the support 13. A pair of extensions 536 extend from opposite end edges 530*b* of the transverse wall portion 530 and extend laterally beyond the end edges of the pair of sidewalls 532. The pair of extensions 536 can be angled relative to the transverse wall portion by an angle of greater than 180° and less than 240° in the same manner as the extensions 36 in the previous embodiment of FIGS. 4-6.

Figure 21:
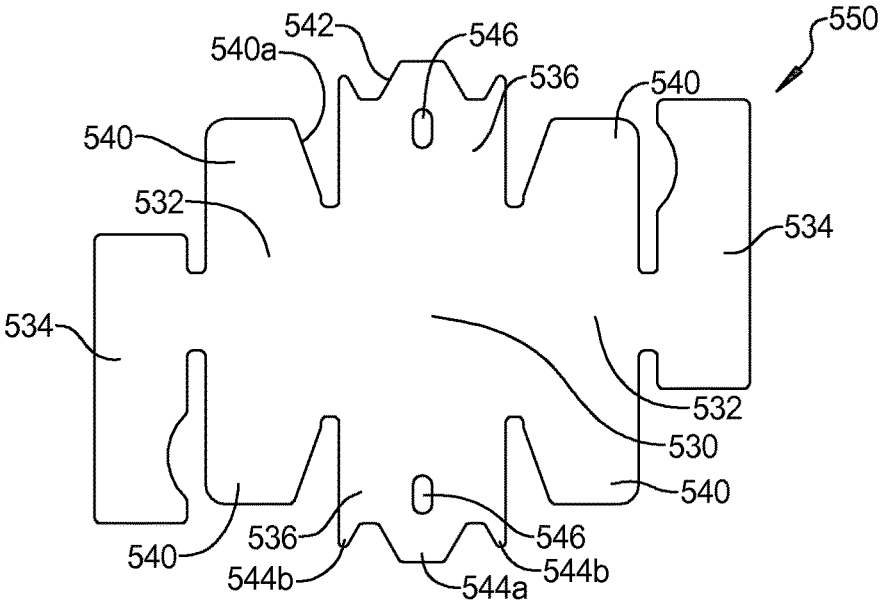
FIG. 21 is a plan view of an exemplary metal blank used to form the flow shaper of FIG. 19.
Figure 22:
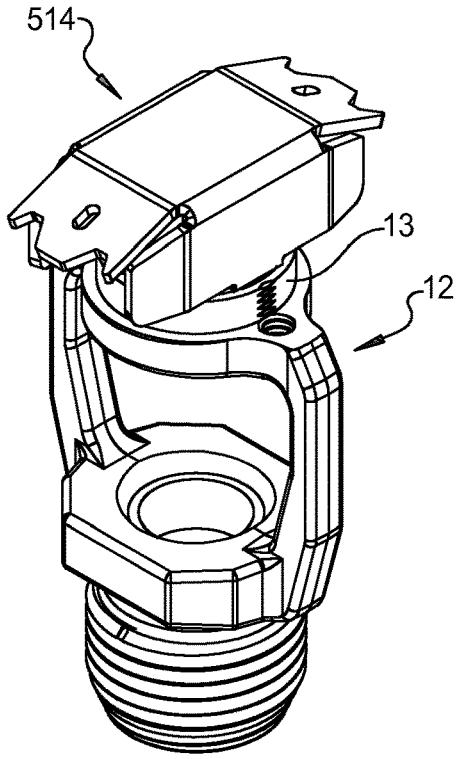
FIG. 22 is a perspective view of a fire protection sprinkler the flow shaper of FIG. 19.
Figure 23:
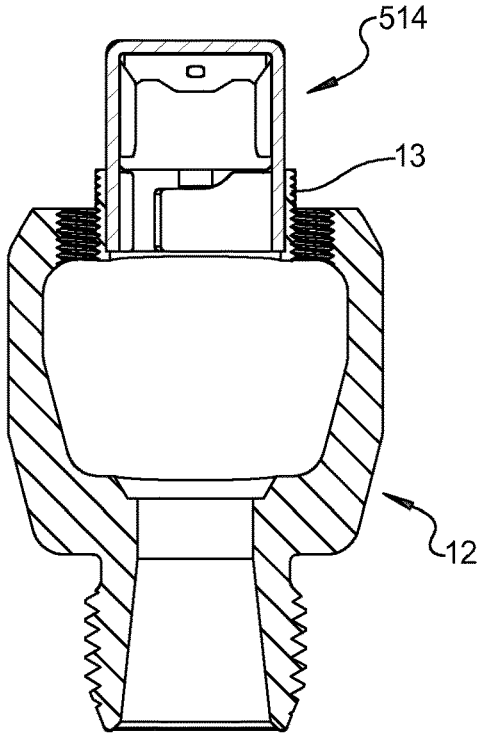
FIG. 23 is a cross-sectional view of the fire protection sprinkler shown in FIG. 22.

A pair of side wall extensions 540 extend from the end edges 532*a* of the sidewalls 532. An upper edge 540*a* of the end wall extensions 540 can be angled so as to approximately aligned with the angle α of the pair of extensions 536. The pair of side wall extensions 540 can also be bent inwardly or outwardly (not shown) so as to direct the water flow toward or away from the pair of extensions 536. The pair of extensions 536 can include one or more slots 542 that define tines 544 disposed at the ends of the pair of extensions 536. In the embodiment shown, a pair of slots 542 are provided in the end of each extension 536 and the tines 544 include a central tine 544*a* and a pair of outer tines 544*b*. The pair of slots 542 can include a pair of lateral sidewalls that are nonparallel (generally V-shaped) to one another and can include a base that connects each of the lateral sidewalls. The pair of extensions 536 can also be provided with one or more apertures 546 extending therethrough to provide a controlled spray of water. The size, shape, number and arrangement of the apertures 546 can be determined based upon a desired flow distribution through the pair of extensions 536. FIG. 21 shows the flow shaper 514 formed from a single plate 550. FIGS. 22 and 23 illustrate a perspective view and a cross-sectional view, respectively, of the flow shaper 514 mounted to a support 13 of a sprinkler body 12.

Figure 24:
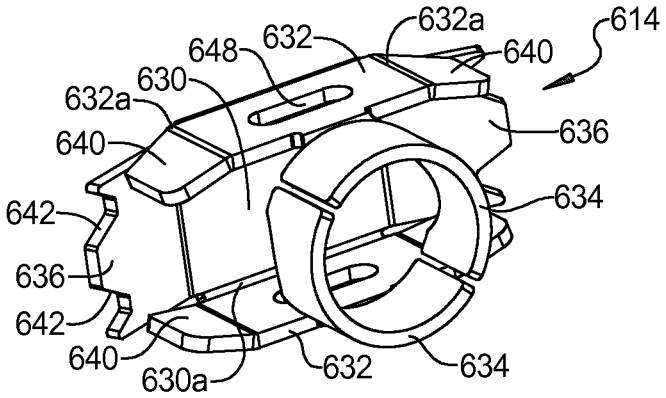
FIG. 24 is a perspective view of the flow shaper according to an alternative embodiment of the present disclosure.
Figure 25:
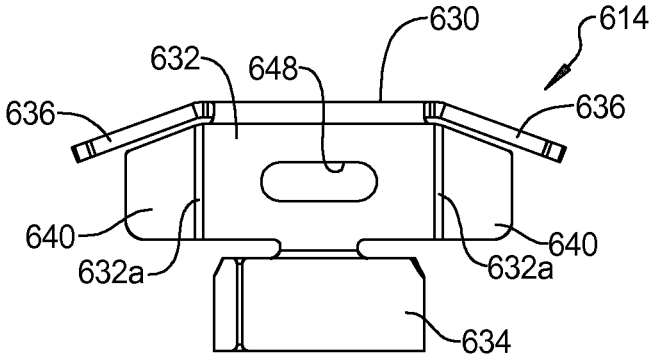
FIG. 25 is a side plan view of the flow shaper shown in FIG. 24.
Figure 26:
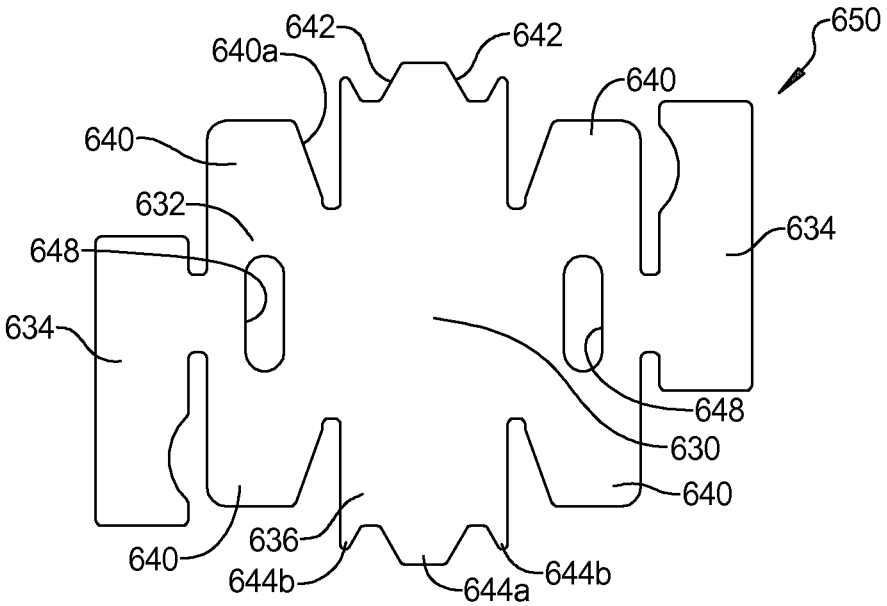
FIG. 26 is a plan view of an exemplary metal blank used to form the flow shaper of FIG. 24.

With reference to FIGS. 24-26, an alternative flow shaper 614 will now be described. The flow shaper 614 includes a transverse wall portion 630 intersecting a central axis X of the discharge opening 20 at a location spaced downstream from the support 13. A pair of laterally spaced sidewalls 632 extend from a pair of side edges 630*a* of the transverse wall portion 630 and axially toward the body 12. A pair of mounting base portions 634 extend from the pair of sidewalls 632 and are received in the opening 17 of the support 13 for connecting the flow shaper 614 to the support 13. A pair of extensions 636 extend from opposite end edges 630*b* of the transverse wall portion 630 and extend laterally beyond the end edges 632*a* of the pair of sidewalls 632. The pair of extensions 636 can be angled α relative to the transverse wall portion by an angle of greater than 180° and less than 240° in the same manner as the extensions 36 in the previous embodiment of FIGS. 4-6. A pair of side wall extensions 640 extend from the end edges 632*a* of the sidewalls 632. An upper edge 640*a* of the end wall extensions 640 can be angled so as to approximately align with the angle α of the pair of extensions 636. The pair of side wall extensions 640 can also be bent inwardly or outwardly (not shown) so as to direct the water flow toward or away from the pair of extensions 636.

The pair of extensions 636 can include one or more slots 642 that define tines 644 disposed at the ends of the pair of extensions 636. In the embodiment shown, a pair of slots 642 are provided in the end of each extension 636 and the tines 644 include a central tine 644*a* and a pair of outer tines 644*b*. The pair of slots 642 can include a pair of lateral sidewalls that are nonparallel (generally V-shaped) to one another and can include a base that connects each of the lateral sidewalls. The pair of laterally spaced sidewalls 632 can include one or more elongated apertures 648 that allow a controlled flow of water laterally outward through the sidewalls 632. In the embodiment shown in FIGS. 24-26, only one aperture 648 is shown although it should be understood that multiple apertures can be sized, shaped, spaced and arranged to provide a desired water distribution therethrough. FIG. 26 shows the flow shaper 614 formed from a single plate 650.

Figure 27:
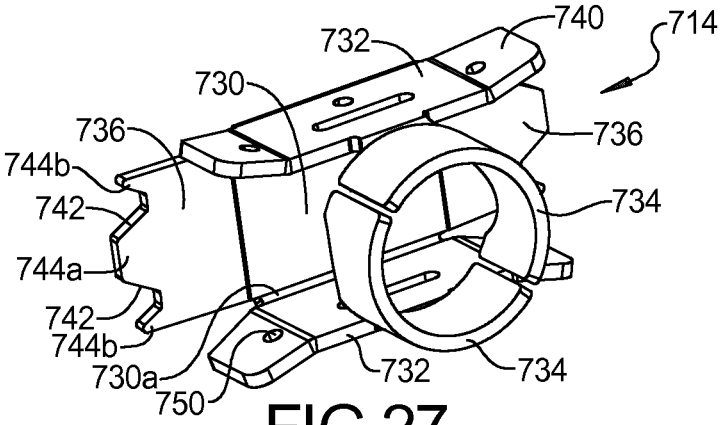
FIG. 27 is a perspective view of the flow shaper according to an alternative embodiment of the present disclosure.
Figure 28:
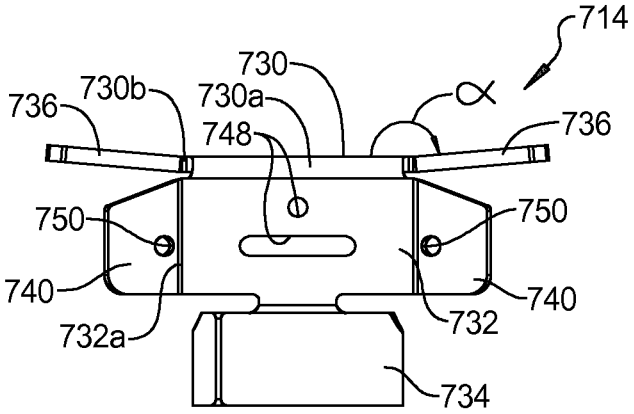
FIG. 28 is a side plan view of the flow shaper shown in FIG. 27.
Figure 29:
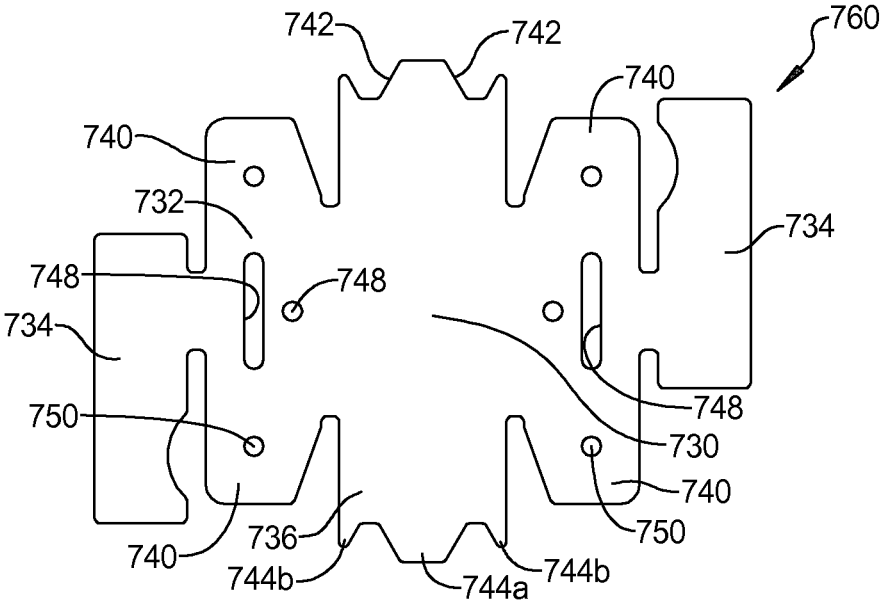
FIG. 29 is a plan view of an exemplary metal blank used to form the flow shaper of FIG. 27.

With reference to FIGS. 27-29, an alternative flow shaper 714 will now be described. The flow shaper 714 includes a transverse wall portion 730 intersecting a central axis X of the discharge opening 20 at a location spaced downstream from the support 13. A pair of laterally spaced sidewalls 732 extend from a pair of side edges 730*a* of the transverse wall portion 730 and axially toward the body 12. A pair of mounting base portions 734 extend from the pair of sidewalls 732 and are received in the opening 17 of the support 13 for connecting the flow shaper 714 to the support 13. A pair of extensions 736 extend from opposite end edges 730*b* of the transverse wall portion 730 and extend laterally beyond the end edges of the pair of sidewalls 732. The pair of extensions 736 can be angled relative to the transverse wall portion by an angle α of greater than 160° and less than 180°. A pair of side wall extensions 740 extend from the end edges 732*a* of the sidewalls 732. The pair of side wall extensions 740 can also be bent outwardly or inwardly (not shown) so as to direct the water flow away from or toward the pair of extensions 736. The pair of extensions 736 can include one or more slots 742 that define tines 744 disposed at the ends of the pair of extensions 736. In the embodiment shown, a pair of slots 742 are provided in the end of each extension 736 and the tines 744 include a central tine 744*a* and a pair of outer tines 744*b*. The pair of slots 742 can include a pair of lateral sidewalls that are nonparallel (generally V-shaped) to one another and can include a base that connects each of the lateral sidewalls.

The pair of laterally spaced sidewalls 732 can include one or more apertures 748 that allow a controlled flow of water laterally outward through the sidewalls 732. The apertures 748 can have varying shapes including circular, oval, elongated and other desired shapes. In the embodiment shown in FIGS. 27-29, only one elongated aperture 748 and one circular aperture 748 is shown although it should be understood that multiple apertures can be sized, shaped, spaced and arranged to provide a desired water distribution therethrough. In addition, the sidewall extensions 740 can also be provided with one or more apertures 750 which can also be sized, shaped spaced and arranged to provide a desired water distribution therethrough. FIG. 29 shows the flow shaper 714 formed from a single plate 760.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sprinkler assembly comprising:

a body including a passageway, an inlet opening, a discharge opening, and a central axis extending through said discharge opening;

a support extending from said body at a first fixed location downstream relative to the discharge opening of the body;

a closure device releasably positioned at said discharge opening to close said passageway;

a heat responsive trigger mounted to releasably retain said closure device at said discharge opening of said body; and a flow shaper non-movably secured to said support at a second fixed location downstream relative to the discharge opening of the body, said flow shaper including a transverse wall portion intersecting said central axis, said transverse wall portion being rectangular with a pair of longer side edges and a pair of relatively shorter end edges a pair of laterally spaced sidewalls integrally formed with and extending from said longer side edges of said transverse wall portion toward said body and a pair of mounting base portions integrally formed with and extending from said pair of sidewalls and connected to the support for supporting the flow shaper to said support.

2. The sprinkler assembly according to claim 1, wherein said transverse wall portion is generally planar.

3. The sprinkler assembly according to claim 1, wherein said pair of laterally spaced sidewalls are generally perpendicular to said transverse wall portion.

4. The sprinkler assembly according to claim 1, wherein said pair of laterally spaced sidewalls are generally planar.

5. The sprinkler assembly according to claim 1, further comprising a pair of extensions extending from opposite ends of said transverse wall portion laterally beyond said pair of sidewalls.

6. The sprinkler assembly according to claim 5, wherein said pair of extensions are angled relative to said transverse wall portion.

7. The sprinkler assembly according to claim 5, wherein said pair of extensions include at least one slot therein.

8. The sprinkler assembly according to claim 5, wherein said pair of extensions include at least one aperture therein.

9. The sprinkler assembly according to claim 1, wherein said pair of sidewalls include at least one aperture therein.

10. The sprinkler assembly according to claim 1, wherein said pair of sidewalls each include a pair of sidewall extensions extending from side edges thereof.

11. The sprinkler assembly according to claim 10, wherein said pair of sidewall extensions extending from said pair of sidewalls include at least one aperture therein.

12. The sprinkler assembly according to claim 10, wherein said pair of sidewall portions includes at least one aperture therein.

13. The sprinkler assembly according to claim 10, wherein said pair of sidewall extensions extending from said pair of sidewalls include at least one slot therein.

14. The sprinkler assembly according to claim 1, wherein said pair of mounting base portions are semi-annular.

15. The sprinkler assembly according to claim 1, wherein said flow shaper is formed from a single metal plate.

16. The sprinkler assembly according to claim 1, wherein said support defines an annular opening.

17. The sprinkler assembly according to claim 1, wherein said transverse wall portion is axially spaced from said support.

18. The sprinkler assembly according to claim 1, wherein said transverse wall portion includes at least one aperture therein.

19. The sprinkler assembly according to claim 18, wherein said at least one aperture includes a plurality of apertures.

20. A sprinkler assembly comprising:

a body including a passageway, an inlet opening, a discharge opening, and a central axis extending through said discharge opening;

a support extending from said body at a first fixed location downstream relative to the discharge opening of the body;

a closure device releasably positioned at said discharge opening to close said passageway;

a heat responsive trigger mounted to releasably retain said closure device at said discharge opening of said body; and a flow shaper non-movably secured to said support at a second fixed location downstream relative to the discharge opening of the body, said flow shaper including a generally planar transverse wall portion intersecting said central axis and having a proximal surface facing the discharge opening and a distal surface facing away from the discharge opening, said transverse wall portion including a pair of opposite end edges and a pair of opposite side edges, wherein said generally planar transverse wall portion is axially spaced from said support, a pair of laterally spaced sidewalls extending from the pair of opposite side edges at an angle relative to the distal surface of the generally planar transverse wall portion from said generally planar transverse wall portion toward said body and a pair of extensions extending from the pair of opposite end edges at an angle of greater than 180° and less than 240° from said transverse wall portion and laterally beyond said pair of sidewalls.

21. The sprinkler assembly according to claim 20, wherein said pair of laterally spaced sidewalls are generally perpendicular to said transverse wall portion.

22. The sprinkler assembly according to claim 20, wherein said pair of laterally spaced sidewalls are generally planar.

23. The sprinkler assembly according to claim 20, wherein said flow shaper is formed from a single metal plate.

24. The sprinkler assembly according to claim 20, wherein said support defines an annular opening.

25. The sprinkler assembly according to claim 20, wherein said pair of extensions include at least one slot therein.

26. The sprinkler assembly according to claim 20, wherein said pair of extensions include at least one aperture therein.

27. The sprinkler assembly according to claim 20, wherein said pair of sidewalls include at least one aperture therein.

28. The sprinkler assembly according to claim 20, wherein said pair of sidewalls each include a pair of sidewall extensions extending from side edges thereof.

29. The sprinkler assembly according to claim 28, wherein said pair of sidewall extensions include at least one aperture therein.

30. The sprinkler assembly according to claim 28, wherein said pair of sidewall portions includes at least one aperture therein.

31. The sprinkler assembly according to claim 20, wherein said pair of sidewall extensions include at least one slot therein.

* * * * *